US007213518B2

(12) United States Patent
Sutcliffe

(10) Patent No.: US 7,213,518 B2
(45) Date of Patent: May 8, 2007

(54) MODULAR ELECTRONIC FUZE

(75) Inventor: Scott A. Sutcliffe, Austin, TX (US)

(73) Assignee: Engel Ballistic Research, Inc., Smithville, TX (US)

( * ) Notice: Subject to any disclaimer, the term of this patent is extended or adjusted under 35 U.S.C. 154(b) by 0 days.

(21) Appl. No.: 10/369,726

(22) Filed: Feb. 21, 2003

(65) Prior Publication Data

US 2004/0163564 A1 Aug. 26, 2004

(51) Int. Cl.
*F42C 11/06* (2006.01)

(52) U.S. Cl. ..... 102/215; 102/218; 102/264; 102/276; 102/426

(58) Field of Classification Search ..... 102/276, 102/264, 215, 200, 424, 426, 218
See application file for complete search history.

(56) References Cited

U.S. PATENT DOCUMENTS 3,500,746 A 3/1970 Ambrosini
3,504,632 A * 4/1970 West et al. ..... 102/264
3,521,616 A * 7/1970 Chang et al. ..... 124/67
3,560,863 A 2/1971 Baumoel
3,622,987 A 11/1971 Borkan
3,628,458 A 12/1971 Sands
3,739,726 A 6/1973 Pintell
3,768,407 A * 10/1973 Saverese, Jr. ..... 102/424
4,150,353 A * 4/1979 Huber et al. ..... 337/231
4,240,350 A * 12/1980 Munzel et al. ..... 102/215
4,320,704 A * 3/1982 Gawlick et al.
4,541,341 A * 9/1985 Fowler et al. ..... 102/215
4,633,779 A 1/1987 Biggs et al.
4,644,864 A 2/1987 Komorowski et al.
5,031,537 A 7/1991 Taylor
5,279,226 A 1/1994 Ritchie et al.
5,335,598 A 8/1994 Lewis et al.
5,390,604 A 2/1995 Ingersoll
5,396,845 A * 3/1995 Backstein et al. ..... 102/427
5,440,990 A 8/1995 Wiedefeld et al.
5,473,986 A 12/1995 Hau
5,499,579 A 3/1996 Lewis
5,585,592 A * 12/1996 Stearns et al.
5,621,184 A 4/1997 Gwynn, III
5,635,667 A * 6/1997 Boyer et al. ..... 102/487
5,721,391 A * 2/1998 Thorsted et al.
5,929,368 A 7/1999 Ewick et al.
6,070,531 A * 6/2000 Hansen et al. ..... 102/202.5
6,085,659 A 7/2000 Beukes et al.

(Continued)

OTHER PUBLICATIONS

GATOR mine system—http://en.wikipedia.org/wiki/CBU-89_Gator.*

(Continued)

*Primary Examiner*—James S. Bergin
(74) *Attorney, Agent, or Firm*—Pravel Intellectual Property Law, P.C.; James W. Pravel

(57) ABSTRACT

A modular fuze assembly is provided for use in multiple types of military ordnance. The fuze comprises a base unit having an initiator for arming the fuze; a timer assembly that includes a programmable clock package; a trigger assembly comprising a line monitoring circuit and a photo-capacitor; and a top cover unit. Each of the individual components are interconnected together to form a single, unitized system. Multiple initiation stages are provided to ensure payload activation.

13 Claims, 3 Drawing Sheets

U.S. PATENT DOCUMENTS

| | | | | |
|---|---|---|---|---|
| 6,129,022 | A | 10/2000 | Hickey et al. | |
| 6,145,439 | A | 11/2000 | Ziemba | |
| 6,244,184 | B1 * | 6/2001 | Tadmor | |
| 6,622,629 | B2 * | 9/2003 | Hodge et al. | 102/235 |
| 6,779,457 | B2 * | 8/2004 | Kutzli et al. | 102/223 |
| 6,799,517 | B1 * | 10/2004 | Cahill | 102/401 |
| 6,834,592 | B2 * | 12/2004 | Koger | 102/439 |

OTHER PUBLICATIONS

BLU-92/B Gator antipersonnel (AP)—http//www.globalsecurity.org/military/systems/munitions/blu-92.htm.*

BLU-92/B Gator antipersonnel (AP)—http://www.globalsecurity.org/military/systems/munitions/blu-91.htm.*

CBU-89 Gator Mine—http://www.fas.org/man/dod-101/sys-dumb/cbu-89.htm.*

The Ordance Shop—Cluster Bombs—http://www.ordnance.org/cluster_bombs.htm.*

Family of Scatterable Mines—FASCAM—http://www.fas.org/man/dod-101/sys/land/fascam.htm.*

Areal Denial Artillery Munition—ADAM—http://en.wikipedia.org/wiki/Area_Denial_Artillery_Munition.*

"Time Delay Electronic Safe, Arm and Fire Device" Brochure, undated, L-3 Communications, Electrodynamics.

"Individual Weapons and Marksmanship", ROTCM 145-30, Dept. of the Army, 1958, pp. 140-142.

"Conventional Armament Industry in the New Millenium", www.milparade.com/2000/37/03_01.shtml pp. 1-3.

"Summary-Explosive remnants of war-Unexploded ordnance and post-conflict communities", The Cooperative Bank plc., 2002.

* cited by examiner

MODULAR ELECTRONIC FUZE

FIELD OF THE INVENTION

The present invention relates to the field of fuzing systems that are used to initiate the firing of ordnance.

BACKGROUND OF THE INVENTION

Traditionally, fuzes used for the initiation of ordnance have relied upon a mechanical system to begin the arming process. The most complex mechanical systems are clockwork driven safety and arming systems. Such systems are activated either with inertia by using a counterweight system that is driven by rotation imparted on the munition by the rifled barrel (For example, see U.S. Pat. No. 6,145,439), or directly by an impeller such as on free fall bombs.

In order for a mechanical system to be reliable, it typically must be large and physically well supported. Such requirements result in fuzes that displace more payload in "man portable weapon systems" where there exists very little room for either the fuze or the payload. For example, in the M406 (40 mm grenade), almost 50% of the projectile is composed of the fuzing assembly.

An alternative fuzing system is also used that includes a less-complex, but many times less reliable, simple impact driven plunger/striker fuze. This type of fuze is initiated by direct contact with the target, which then drives a plunger/striker against a percussion type initiator. If however, insufficient force is imparted against the plunger/striker, then the fuze will fail to initiate. Such an insufficient force can occur for example, if there is a glancing blow or the ordnance strikes a soft target. Because most mechanical fuzes include a combination of both clockwork timing and impact devices, they typically suffer from excessive size, weight and complexity. As a result, their inherent reliability is generally reduced.

If a fuze fails to initiate due to a malfunction, because a glancing blow or a target of insufficient mass failed to initiate the fuze, a very dangerous situation can result. Unexploded ordinance ("UXO") creates a very persistent and long-term danger. Highly trained specialists are required to neutralize UXO and do so at great personal risk of injury or death. Furthermore, UXO may be left undetected and undisturbed for many months or years later and can cause injury or death to unsuspecting innocent children or adults.

SUMMARY OF THE INVENTION

A modular, inventive fuze assembly is provided for use in multiple types of military ordinance. The fuze comprises a base unit having an initiator for arming the fuze; a timer assembly that includes a programmable clock package; a trigger assembly comprising a line monitoring circuit and a photo-capacitor; and a top cover unit. The top cover unit, trigger assembly, timer assembly and base unit are interconnected together to form a single unitized system. The unitized system is compact and lightweight and may be readily assembled into military ordnance and signaling devices.

The modular, inventive fuze assembly can use any combination of external triggers, such as electronic, or mechanical; or a combination of both.

Further, the modular, inventive fuze includes multiple initiation stages that together ensure payload activation. Also included is an independent self-destruct system that is designed to prevent UXO hazards.

A removable and replaceable power source is provided to enhance safety and increase shelf life.

The inventive fuze is specifically designed with modifiable modular components so that it may be modified to evolve when requirements dictate.

DETAILED DESCRIPTION OF PREFERRED EMBODIMENT

Figure 2:
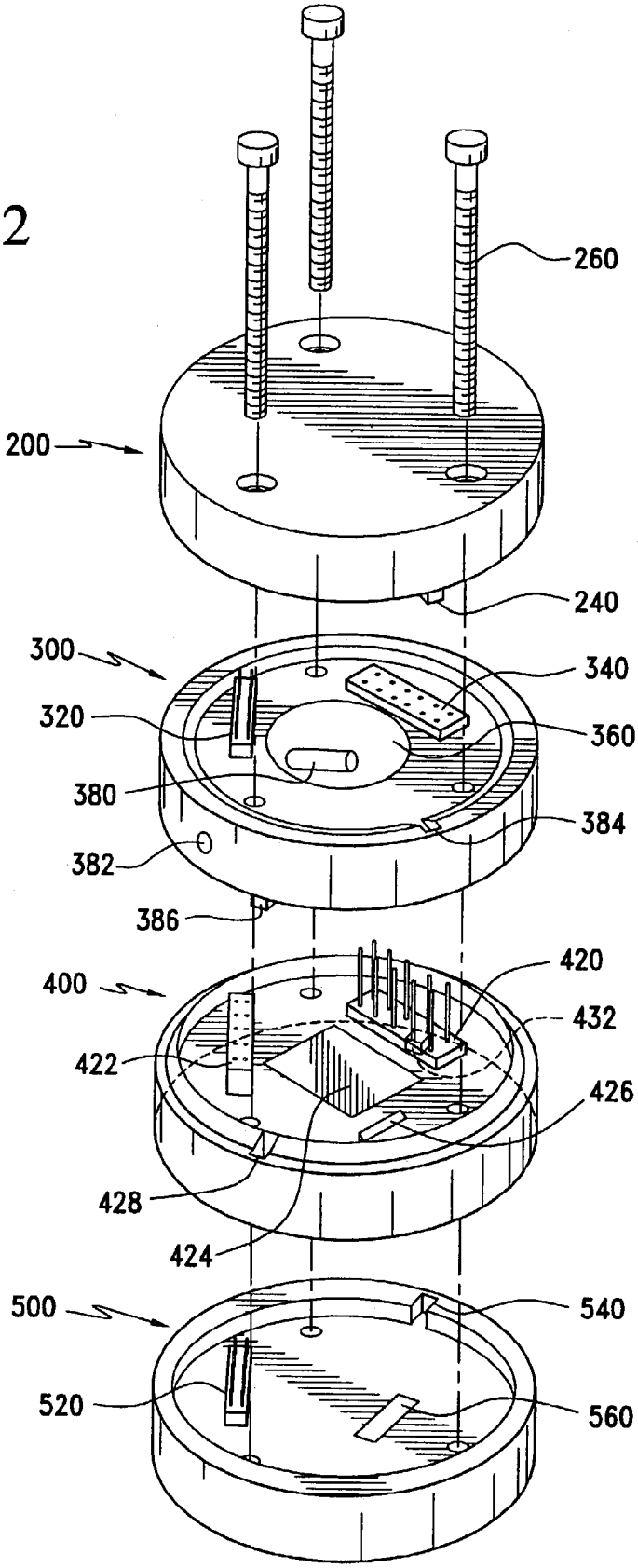
FIG. 2 shows an assembly view of an embodiment of the inventive fuze including the top cover unit, the trigger assembly, the timer assembly and the base unit.

For purposes of clarification, the following table includes a list of parts for the embodiment shown in FIG. 2.

| Part Number: | Description: |
|---|---|
| 200 | Top Cover: |
| Not Shown | Interconnect-female-Trigger Assembly to Top Cover |
| 240 | Alignment key |
| 260 | Machine Screws |
| 300 | Trigger Assembly: |
| 320 | Interconnect-male-Trigger Assembly to Top Cover |
| 340 | Interconnect-female-Timer Assembly to Trigger Assembly |
| 360 | Line monitoring circuit |
| 380 | Photo-capacitor |
| 382 | Mechanical safety wire hole |
| 384 | Alignment slot |
| 386 | Alignment key |
| 400 | Timer Assembly: |
| 420 | Interconnect-male-Timer Assembly to Trigger Assembly |
| 422 | Interconnect-female-Base to Timer Assembly |
| 424 | Programmable Clock Assembly |
| 426 | Oscillator |
| 428 | Alignment slot |
| 432 | Alignment key |
| 500 | Base: |
| 520 | Interconnect-male-Base to Timer Assembly |
| 540 | Alignment slot |
| 560 | Initiator |

Figure 1:
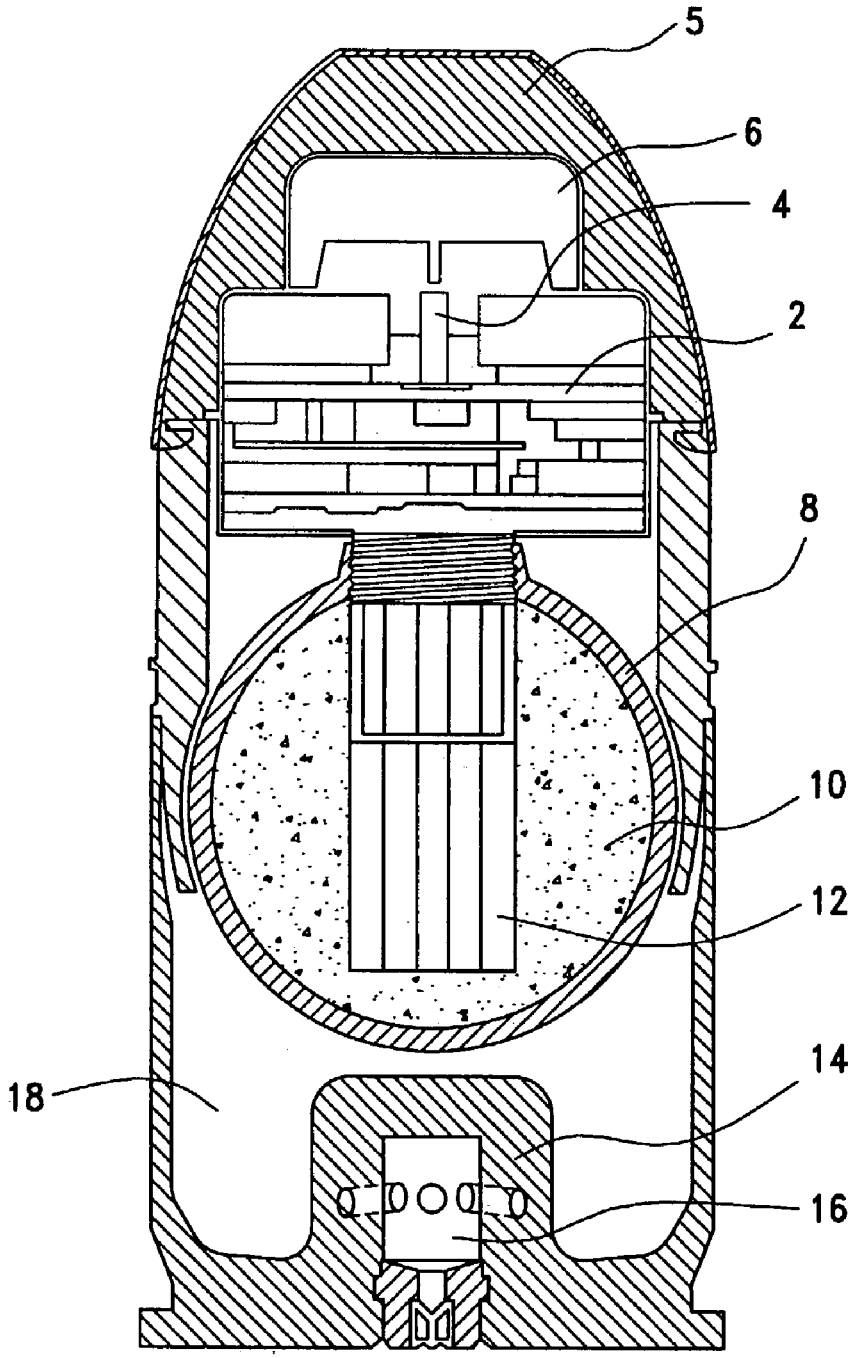
FIG. 1 (PRIOR ART)
FIG. 1 shows a typical 40-mm cartridge, in which the inventive fuze may be used.

FIG. 1 shows a conventional 40 mm rifle launched grenade, for which the inventive fuze may be used. The fuze assembly 2, in a conventional 40 mm grenade occupies a substantial portion of the projectile. The pressure plate 6, strikes the impact driven striker 4, which initiates the detonator 12, to activate the explosive payload 10. Such a conventional design requires a sufficient impact for the pressure plate 6 to force the impact driven striker 4 to initiate the detonator 12. Such an impact may be lacking in situations where the ogive 5 does not hit a target directly. This results in a glancing blow. Similar situations exist where the ogive 5 hits a soft target, such as mud, snow or sand.

Structure Description of a Preferred Embodiment

The modular, inventive fuze system is an electrically operated, electrically initiated digital timer with an external trigger. The fuze system includes redundant self-destruct systems. Referring specifically to FIG. 2, an embodiment of the inventive fuze includes the following subassemblies:

1. Base 500, which includes the initiator 560 or initiator contacts;
2. Timer assembly 400, which contains the electronics package;
3. Trigger assembly 300, which includes the line monitoring circuit 360, that is used for payload activation and a photo-capacitor 380, that is used for self-destruction; and
4. Top cover 200, which interconnects with the trigger assembly 300 and may be modified according to the desired application.

The base 500, timer assembly 400, trigger assembly 300 and top cover 200 are typically fabricated from metal or a composite construction and include relief areas and pass through cuts, which allow component insertion and electrical interconnection. Upon final assembly they will create a sealed, "laminate" type structure, which will offer the internal components a high degree of protection and shielding while reducing manufacturing complexity.

The top cover 200, illustrated in FIG. 2, includes a female interconnect (not shown) to electrically connect the top cover 200 to the trigger assembly 300. An alignment key 240 provides proper alignment with the trigger assembly 300.

The trigger assembly 300 includes a male interconnect 320 to electrically connect the trigger assembly 300 to the top cover 200. A female interconnect 340 electrically connects the trigger assembly 300 to the male interconnect 420 on the timer assembly 400. A line monitoring circuit 360 is provided as part of the redundant system to be explained herein. A photo-capacitor 380, is also a component of the redundant system. The mechanical safety wire hole 382 may be used optionally for a mechanical safety wire system.

The timer assembly 400 contains a programmable clock assembly 424 and oscillator 426, to be explained herein.

The base 500 includes an initiator 560 for initiating the activation of the fuze. Initiation can be achieved with external devices connected to the base 500 externally or with a mechanical or electrical initiator 560.

The female interconnect 422 electrically connects the timer assembly 400 to the male interconnect 520 on the base 500.

An alignment slot 428 is provided to align with the alignment key 386 on the trigger assembly 300, during assembly. The pairs of alignment slots and keys are offset around the perimeter relative to each of the other sets so that only one possible assembly may be made between the individual assemblies. The position of alignment key 240 on the top cover 200 and the mating alignment slot 384 are at a different position on the perimeter of the fuze assembly than the alignment key 386. Similarly, the alignment key 386 on the trigger assembly 300, which engages alignment slot 428 on the timer assembly 400 are located at a different position on the perimeter of the fuze assembly than the alignment key 432 on the timer assembly 400 and the mating alignment slot 540 on the base/initiator 500.

Description of Timer and Redundant Trigger Operation

Figure 3:
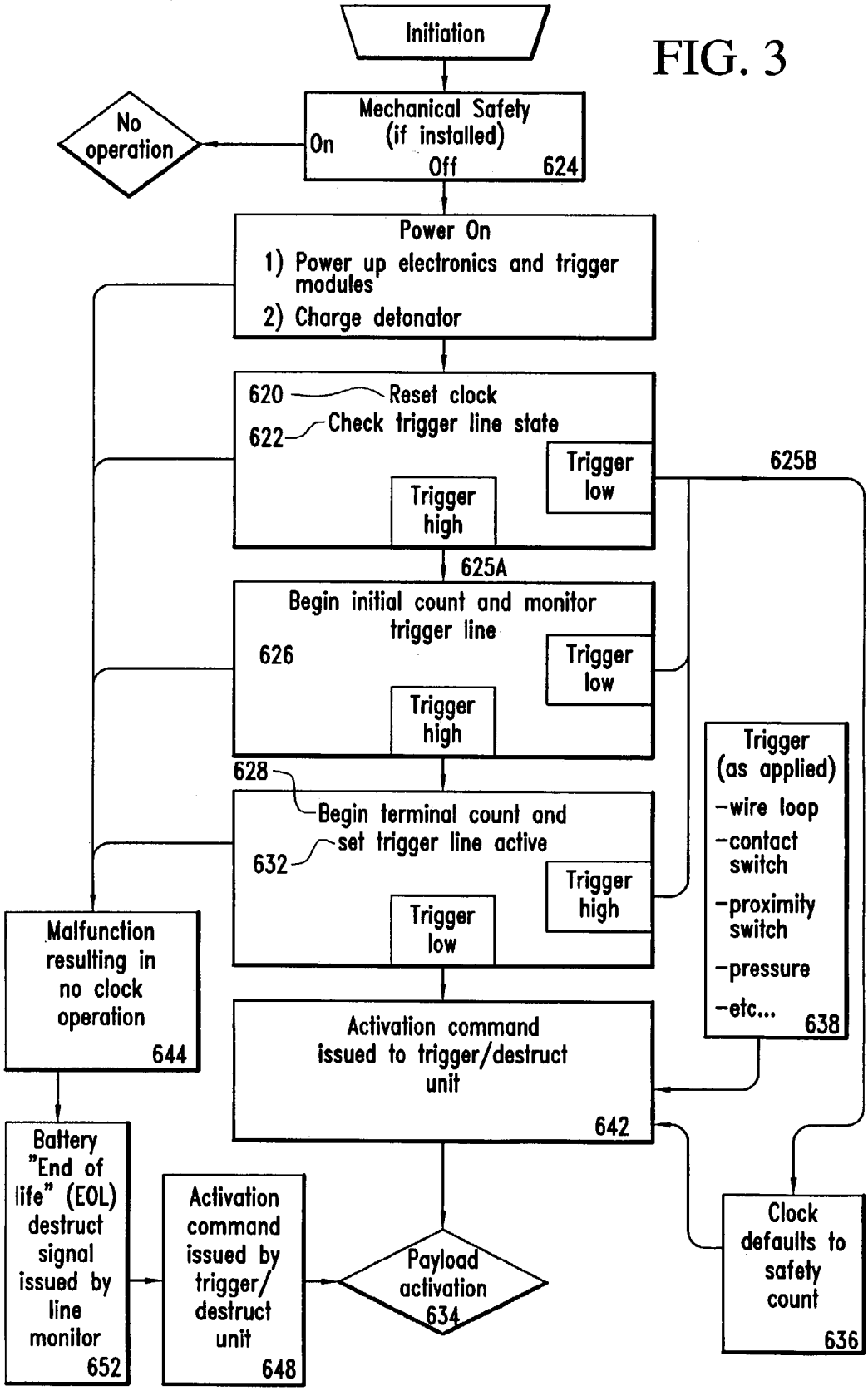
FIG. 3 shows a logical flow chart of the operation of the inventive fuze.

FIG. 3 provides a flow chart illustration of the sequence of operational steps during the timer and redundant trigger operation.

Upon power up, the programmable clock assembly 424, will initiate a reset cycle 620, which consists of four separate events:

1. Clock reset 620;
2. Power up the electronics and trigger modules in the trigger assembly 300 and charge the detonator.
3. Check the state of the safety/trigger circuit 622; and
4. Start the count as dictated by the state of the safety/trigger circuit.

Upon power-up/reset, the electronics package checks the state of the safety/trigger circuit and begins a count in one of two modes. If the safety/trigger circuit returns a "high" state 625*a* (i.e. the circuit is closed), the programmable clock 424 begins an initial count 626, which prevents activation of the payload, regardless of the subsequent state of the trigger. This allows the device in which the fuze is installed to travel a minimum distance from the launch system or firer before it is armed.

If the safety/trigger loop changes to a "low" state 625*b* (open circuit) during the initial count due to an unintended impact or other malfunction, the programmable clock 424 resets to a default safety count 636, which allows the launch system or firer time to seek appropriate cover or distance from the ordnance, in which the fuze provided.

If the safety/trigger circuit remains in a high state 625*a* throughout the initial count 626, the clock resets to a predetermined terminal count 628 and sets the trigger line to active 632.

After activating the trigger line 632, the fuze changes to an active mode and monitors the trigger for any state change. If the trigger changes to a low state, the terminal count is aborted, an activation command is issued 642, and payload activation 634 is instantaneous.

By using an electrical trigger signal, payload activation 634 can be initiated by various types of switches 638, including but not limited to a wire loop contact system, a magnetic proximity switch, a thermal sensor, a mechanical switch or a pressure switch.

Because a "low", or open circuit trigger signal is used, initiation can also occur if the physical triggering device is destroyed, for example, by impact. If the programmable clock 424 should complete either the default safety count 636 or the terminal count 628, payload activation is initiated. This creates a "timeout" activation, which gives the payload the ability to initiate even if no hard impact or other trigger event occurs. This provides triggering redundancy and reduces unexploded ordnance (UXO) hazards during training or on the battlefield. The initial count and the terminal count durations can be changed on the programmable clock assembly 424 at the factory during assembly, or optionally, by the field operator. The top cover may be provided with external electrical connections that allow external reprogramming of the clock. Such an option will allow a field operator to make reprogramming changes to the timing of the initial count and terminal count durations.

While the timer assembly 400 is initializing, the trigger assembly 300 will be charged as long as the primary safety has been removed (if such a safety option is installed). The trigger assembly 300 comprises a photo-capacitor 380 and a line monitoring circuit 360. By monitoring the current supply, the line monitoring circuit 360 ensures that an ample amount of reserve current is available for payload activation at all times and under all conditions. The line monitoring circuit 360 controls the payload initiation by receiving the destruct command from the trigger assembly 300 and it monitors the voltage level of the battery (not illustrated).

A secondary function of the trigger assembly 300 is to act as a self-destruct system. If no trigger signal is received from the programmable clock assembly 424, the battery will continue to charge the trigger assembly 300. This stage of operation is illustrated in FIG. 3 as a malfunction resulting in no clock operation 644. If the battery voltage is reduced below a minimum level, the line monitoring circuit 360 will issue an end of life ("EOL") destruct signal 652 that will allow the photo-capacitor 380 to discharge across the trigger circuit thereby initiating the activation of the payload 648. This situation could occur for example, if the clock circuitry was defective or was damaged. This feature further reduces the potential for UXO hazards to personnel and equipment. The reserve time of the battery will vary according to variables such as temperature and battery age, but should occur within a predictable window of time.

It is contemplated that variations will occur from the specific preferred embodiment disclosed herein, but such variations will fall within the letter and spirit of the invention according to the following claims.

What is claimed is:

1. A modular fuze assembly for use in multiple types of military ordnance comprising:

a. an initiator for arming the fuze;

b. a trigger assembly for activating payload in the ordnance;

c. a timer assembly that includes a programmable clock package that provides an activation count to said trigger assembly; wherein said trigger assembly and said timer assembly are interconnected together to form a unitized system; and e. a self-destruct system to charge and activate said trigger assembly, independently of a preset period of time.

2. A modular fuze assembly according to claim 1, wherein said trigger assembly optionally includes a mechanical safety.

3. A modular fuze assembly according to claim 1 wherein said initiator is selected from the group consisting of mechanical switches and electrical switches.

4. A modular fuze assembly according to claim 1 wherein a top cover unit is provided having an electrical connection to an external trigger and to a power unit.

5. A modular fuze assembly according to claim 4 wherein said power unit is replaceable.

6. A modular fuze assembly according to claim 1 wherein a top cover unit is on one end of said assembly, said trigger assembly is positioned next to said top cover unit, said timer assembly is positioned next to said trigger assembly and a base assembly is position next to said timer assembly.

7. A modular fuze assembly according to claim 6 wherein said base unit, said timer assembly, said trigger assembly and said top cover assembly each include an electrical throughput whereby each of said enclosures may be assembled one on top of the other.

8. A modular fuze assembly according to claim 7 wherein said electrical throughput provides electrical continuity between said base unit to said timer assembly to said trigger assembly and to said top cover unit.

9. A modular fuze assembly according to claim 7 wherein a polymer resin material is inserted into each of said base unit, said timer assembly, said trigger assembly and said top cover unit whereby protection is provided against chemical agents, moisture, mechanical shock and electrical shorting.

10. A modular fuze assembly according to claim 7 wherein a mechanical safety is inserted through an opening in said enclosure of said trigger assembly to prevent the activation of said initiator.

11. The modular fuze assembly according to claim 1 wherein said self-destruct system charges and activates said trigger assembly if there is less than a minimum amount of voltage detected by a line monitoring circuit.

12. The modular fuze assembly according to claim 1 wherein said self-destruct system charges and activates said trigger assembly if no signal is received from said clock assembly.

13. The modular fuze assembly according to claim 1 wherein said self-destruct system charges and activates said trigger assembly with a photo-capacitor.

* * * * *